US008123150B2

(12) United States Patent
Khan et al.

(10) Patent No.: US 8,123,150 B2
(45) Date of Patent: Feb. 28, 2012

(54) VARIABLE AREA FUEL NOZZLE

(75) Inventors: Abdul Rafey Khan, Greenville, SC (US); Joseph Citeno, Greenville, SC (US); Christian Xavier Stevenson, Inman, SC (US); Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/750,192

(22) Filed: Mar. 30, 2010

(65) Prior Publication Data

US 2011/0240769 A1 Oct. 6, 2011

(51) Int. Cl.

| | |
|---|---|
| ***F02M 59/00*** | (2006.01) |
| ***F02M 61/20*** | (2006.01) |
| ***B05B 7/12*** | (2006.01) |
| ***B05B 1/30*** | (2006.01) |
| ***B63H 25/46*** | (2006.01) |

(52) U.S. Cl. ..... 239/533.9; 239/265.17; 239/407; 239/410; 239/533.2; 239/570; 239/583

(58) Field of Classification Search ..... 239/265.17, 239/265.19, 265.25, 407, 410, 412, 533.2, 239/533.9, 540, 541, 570, 571, 583; 60/39.27, 60/39.281, 771; 251/28, 35, 43; 137/528, 137/541, 543, 543.15, 543.17

See application file for complete search history.

(56) References Cited

U.S. PATENT DOCUMENTS

| | | | | |
|---|---|---|---|---|
| 3,444,886 | A * | 5/1969 | Bailey et al. | 137/541 |
| 3,600,891 | A | 8/1971 | Gordon | |
| 3,622,082 | A | 11/1971 | Tyre | |
| 3,645,645 | A | 2/1972 | Gammill et al. | |
| 3,719,427 | A | 3/1973 | Davis | |
| 3,786,992 | A | 1/1974 | Robinson | |
| 3,868,061 | A * | 2/1975 | Hehl | 239/571 |
| 4,049,198 | A | 9/1977 | Maurer | |
| 4,181,144 | A * | 1/1980 | Landen | 137/484.4 |
| 4,245,787 | A | 1/1981 | Freid | |
| 4,440,347 | A | 4/1984 | Madden et al. | |
| 4,867,637 | A | 9/1989 | Hayama | |
| 5,078,324 | A | 1/1992 | DuBell et al. | |
| 5,092,126 | A | 3/1992 | Yano | |
| 5,141,159 | A | 8/1992 | Langley | |
| 5,207,787 | A | 5/1993 | Lewis | |
| 5,273,213 | A | 12/1993 | Lewis | |
| 5,975,061 | A * | 11/1999 | Briggs et al. | 123/514 |

(Continued)

FOREIGN PATENT DOCUMENTS

GB 2016673 A 9/1979

(Continued)

OTHER PUBLICATIONS

European Search Report and Opinion issued Jul. 20, 2011 in connection with corresponding EP Application No. EP 11159918.9.

*Primary Examiner* — Len Tran
*Assistant Examiner* — Ryan Reis
(74) *Attorney, Agent, or Firm* — Cantor Colburn LLP

(57) ABSTRACT

A nozzle is provided and includes a circuit by which fuel is delivered to a nozzle part and a valve, interposed between the circuit and the nozzle part and upon which the fuel impinges, an opening and closing of the valve being passively responsive to a fuel pressure in the circuit such that the valve thereby modulates a size of an area through which a corresponding quantity of the fuel flows from the circuit to the nozzle part.

18 Claims, 6 Drawing Sheets

U.S. PATENT DOCUMENTS

| | | | | |
|---|---|---|---|---|
| 5,996,618 | A * | 12/1999 | Saito | 137/543 |
| 6,302,370 | B1 | 10/2001 | Schwoerer et al. | |
| 6,318,070 | B1 | 11/2001 | Rey et al. | |
| 6,523,339 | B2 | 2/2003 | Hubbard | |
| 6,735,936 | B2 | 5/2004 | Rey et al. | |
| 6,910,328 | B1 | 6/2005 | Joyce | |
| 6,938,404 | B2 | 9/2005 | Awdalla | |
| 7,004,047 | B2 | 2/2006 | Rey et al. | |
| 7,178,338 | B2 | 2/2007 | Whurr | |
| 7,458,221 | B1 | 12/2008 | Arnold et al. | |

FOREIGN PATENT DOCUMENTS

| | | | |
|---|---|---|---|
| GB | 2055186 | A | 2/1981 |
| GB | 2230333 | A | 10/1990 |

* cited by examiner

VARIABLE AREA FUEL NOZZLE

BACKGROUND OF THE INVENTION

The subject matter disclosed herein relates to a variable area fuel nozzle.

Dry Low NOx (DLN) combustors are widely used for power generation as well as oil and gas production applications and are mainly designed for use with natural gas fuel and/or liquid fuels. New applications of the combustors are, however, beginning to demand that the combustors exhibit wider fuel flexibility. For example, in many cases currently operating combustors must have the capability to operate on natural gas fuels and then switch to low British Thermal Unit (BTU) fuels where fuel flow rates double and still meet emissions and operability requirements.

In these cases, as fuel flow rates of the alternate fuels can be significantly greater than those of other fuels, additional circuits need to be installed to maintain fuel side pressure ratios to satisfy fuel delivery specifications. These additional circuits often require active controls, purge circuits and/or additional equipment and are, therefore, expensive and costly to maintain. In addition, dynamics effects due to varying pressure levels within the circuits can be problematic.

BRIEF DESCRIPTION OF THE INVENTION

According to one aspect of the invention, a nozzle is provided and includes a circuit by which fuel is delivered to a nozzle part and a valve, interposed between the circuit and the nozzle part and upon which the fuel impinges, an opening and closing of the valve being passively responsive to a fuel pressure in the circuit such that the valve thereby modulates a size of an area through which a corresponding quantity of the fuel flows from the circuit to the nozzle part.

According to another aspect of the invention, a nozzle is provided and includes a selectively operated circuit, including a body formed to define an orifice, by which fuel is delivered to a nozzle part and a valve, interposed between the circuit and the nozzle part and upon which the fuel impinges, which passively opens and closes the orifice in response to a fuel pressure in the circuit, the opening and closing of the orifice by the valve thereby modulating a size of an area through which a corresponding quantity of the fuel flows from the circuit to the nozzle part.

According to yet another aspect of the invention, a nozzle is provided and includes a selectively operated circuit, including a body formed to define one or more orifices, by which fuel is delivered to a nozzle part and a valve associated with each of the orifices, each valve being interposed between the circuit and the nozzle part and upon each of which the fuel impinges, which passively opens and closes the respective orifice in response to a fuel pressure in the circuit, the opening and closing of the respective orifices by each of the valves thereby modulating a size of an area through which a corresponding quantity of the fuel flows from the circuit to the nozzle part.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

A dual gas fuel nozzle allows for use of a relatively wide range of molecular wobbe index fuels in hardware geometries. This dual gas fuel nozzle can burn up to about 100% natural gas fuel to low British Thermal Unit (BTU) fuels having about 100 to about 400 BTUs per standard cubic foot, like high reactivity syngas or low reactivity highly diluted streams, by utilizing passively or actively controlled multiple internal fuel passages located within the fuel nozzle. For example, two circuits may be employed and joined internally to a fuel nozzle where one fuel stream provides shielding to the other and prevents it from direct exposure and ingestion of hot combustor flame or combustion products that, if remain unpurged, could result in hardware damage.

At least one of these circuits provides for a variable flow area that is regulated passively or actively actuated by the fuel side pressure. As the pressure in the fuel circuit rises due to increased mass flow, a valve or some other suitable device disposed with respect to the circuit opens and provides variable fuel flow area to meet the flow demand while maintaining reasonable fuel feed stream pressures. Valve settings and features can be custom designed based on the application demands.

Figure 1:
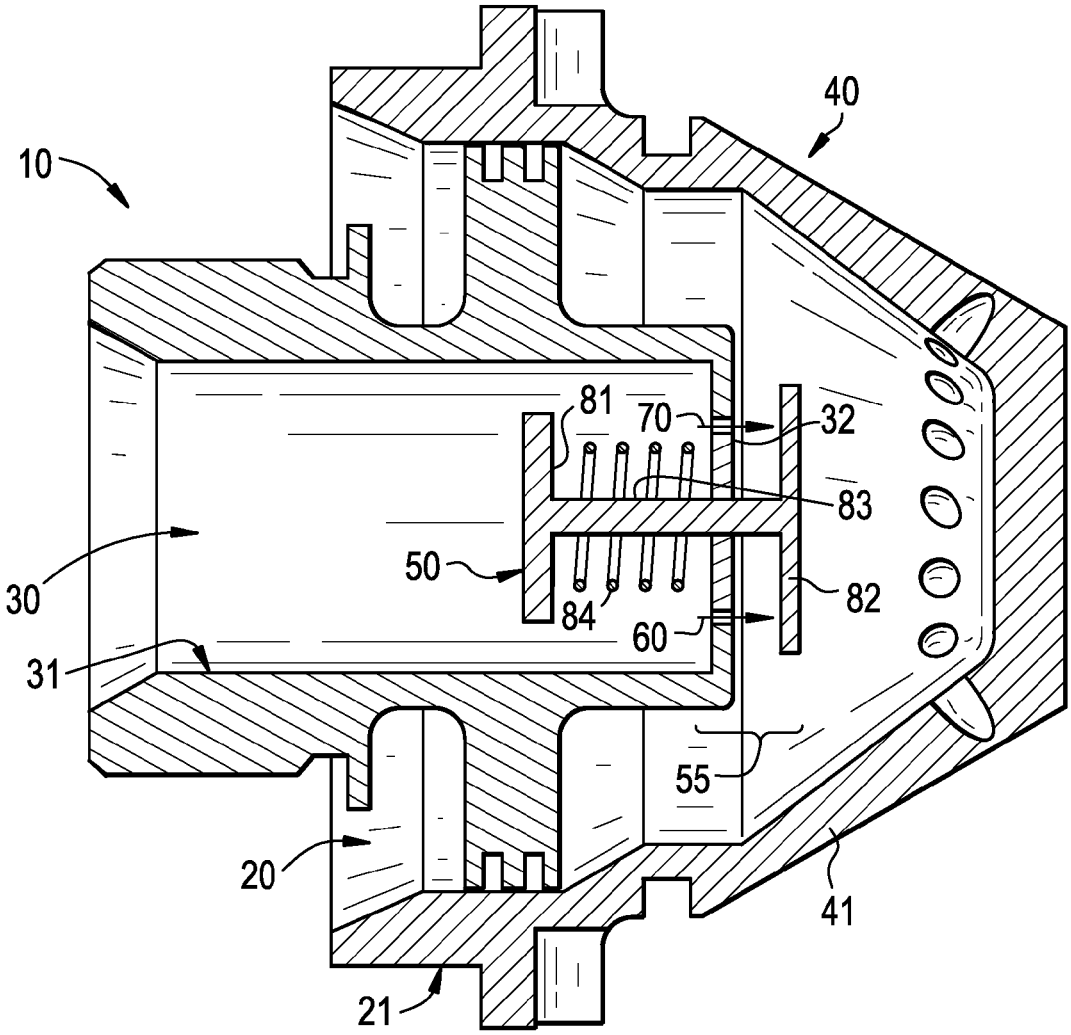
FIG. 1 is a side sectional view of a fuel nozzle.

With reference to FIG. 1, a fuel nozzle 10 is provided. The fuel nozzle 10 may be employed for various applications including, but not limited to, dry low NOx (DLN) combustors of gas turbine engines. The fuel nozzle 10 includes a first fuel circuit 20 and a second fuel circuit 30 by which first and second fuels are delivered to nozzle part 40. The first fuel is delivered to nozzle part 40 through fixed slots and the second fuel is delivered to nozzle part 40 by way of a valve 50. The valve 50 is interposed between the second fuel circuit 30 and the nozzle part 40 with the second fuel impinging on the valve 50 at a second fuel pressure. The valve 50 is passively responsive to this second fuel pressure and thereby modulates a size of an area 55 through which a corresponding quantity of the second fuel flows from the second fuel circuit 30 to the nozzle part 40. The flow of the second fuel maintains the valve 50 in a substantially equilibrated state as long as the second fuel circuit 30 is operated.

In accordance with embodiments, the second fuel is a relatively low BTU fuel as compared to the first fuel. For example, the first fuel may include natural gas or a combination of natural gas and synthetic gas (Syngas) whereas the second fuel may include only Syngas. The second and the first fuel can also be the same fuel such as low BTU Syngas. The second fuel circuit 30 may be selectively operated in accordance with internal and external conditions, such as the availability of certain fuels and, in a case where the fuel nozzle 10 is a component of a gas turbine engine, turbine loads that require a given level of energy production from the available fuels.

The first fuel circuit 20 and the second fuel circuit 30 may each be annular in shape with the second fuel circuit 30 disposed within the first fuel circuit 20. Each may terminate at similar axial locations proximate to the nozzle part 40. The second fuel circuit 30 may be defined through a circuit body 31 with the first fuel circuit 20 being defined through an annular space between the circuit body 31 and annular casing 21. The nozzle part 40 includes section 41 aligned with the annular casing 21 and partially surrounding an end of the circuit body 31.

The valve 50 may be spring-loaded and linearly responsive to a change in the second fuel pressure. That is, the valve 50 may open and close in direct proportion to increases or decreases in the second fuel pressure. In alternate embodiments, the valve 50 may be non-linearly responsive to the second fuel pressure changes. Here, the valve 50 opens and closes more or less responsively as the second fuel pressure increases or decreases significantly. In still further embodiments, the valve 50 may be linearly responsive to relatively small or large second fuel pressure changes and non-linearly responsive to relatively large or small second fuel pressure changes. In a similar manner, the spring-loaded valve 50 may be configured to at least one of linearly and non-linearly modulate the size of the area in passive response to second fuel pressure changes.

Figure 5:
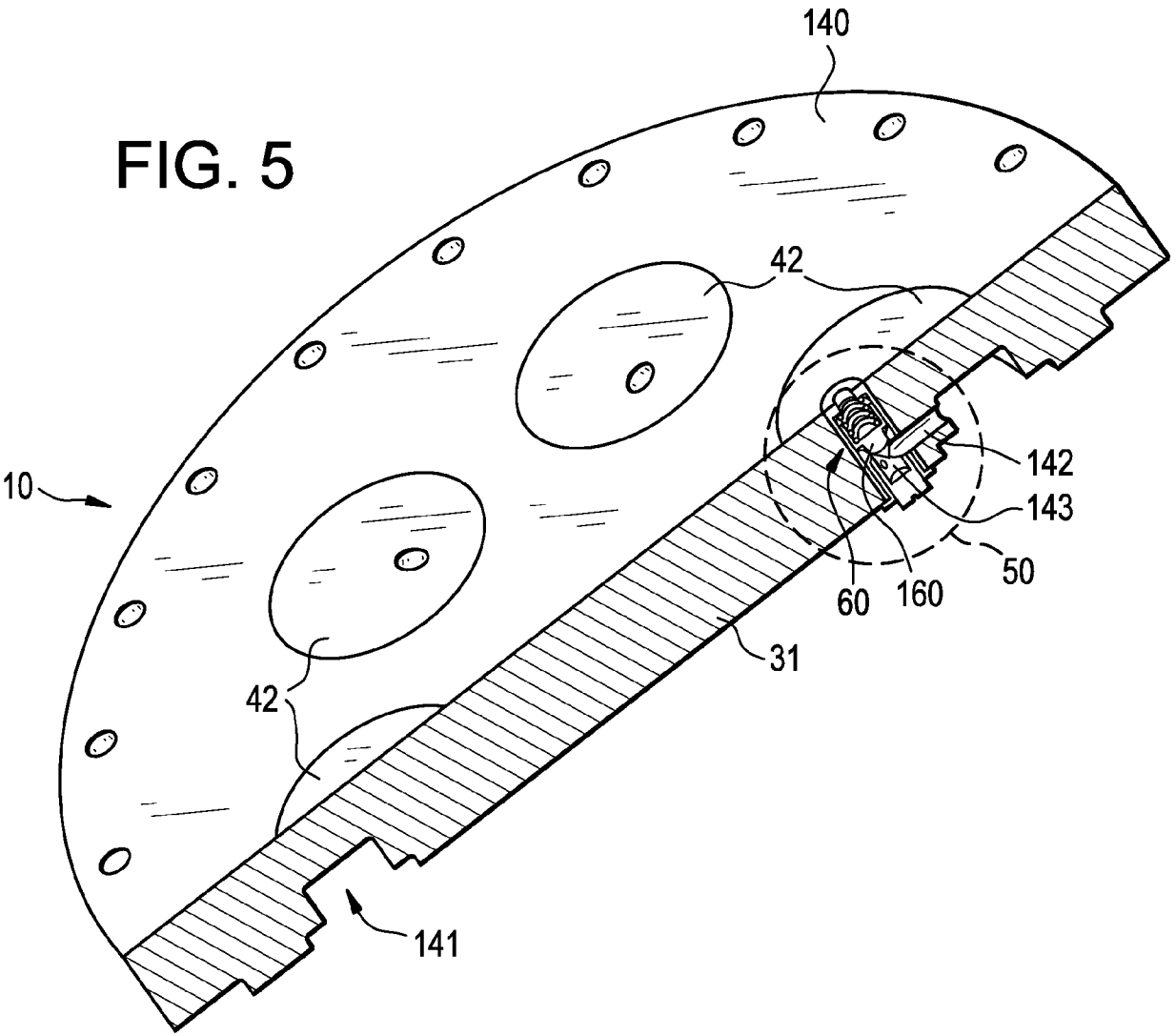
FIG. 5 is a perspective view of an end cover with a multi-fuel nozzle.
Figure 6:
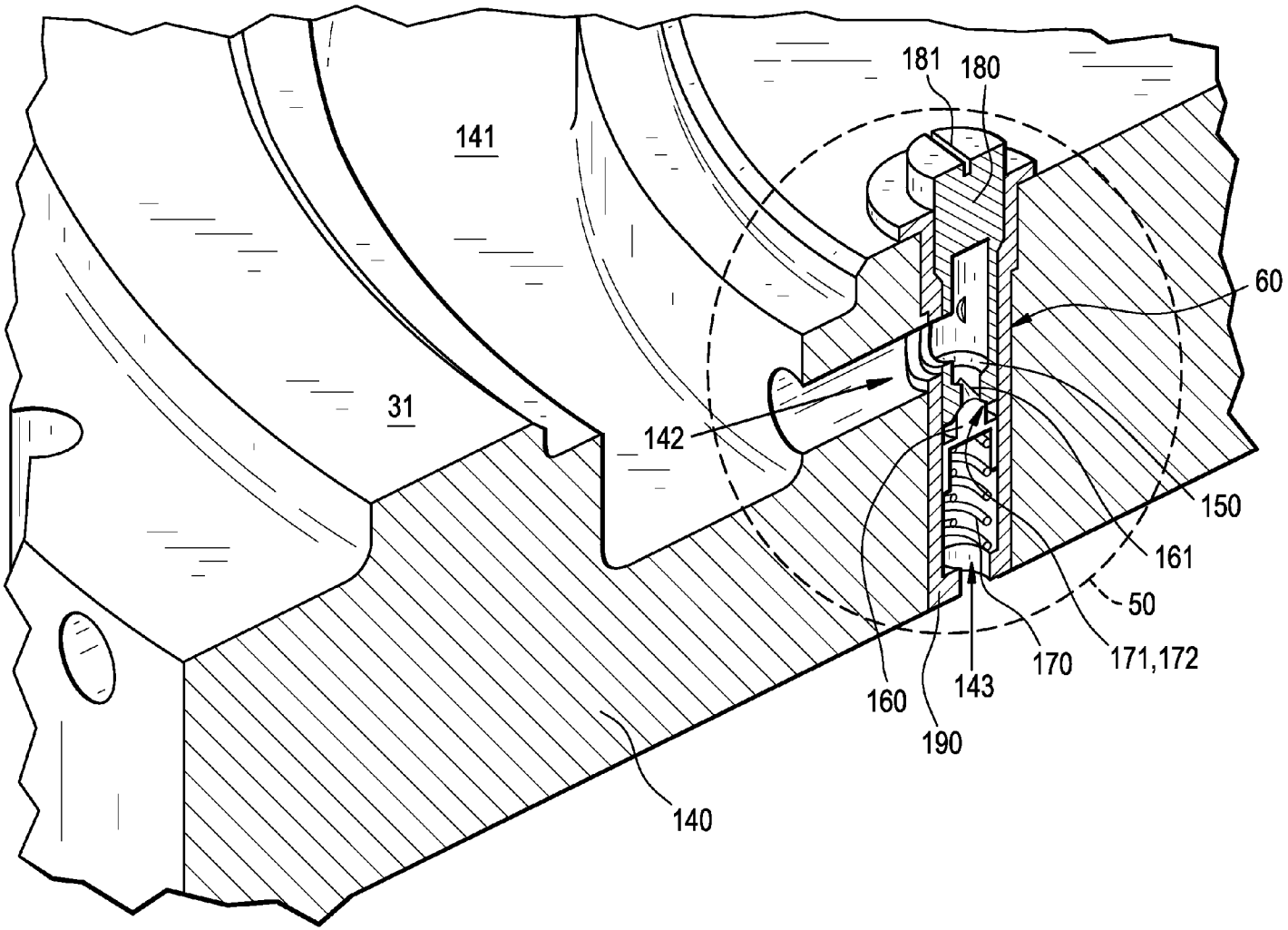
FIG. 6 is a perspective view of a valve according to embodiments.

With reference now to FIGS. 1-4, the valve 50 may passively open and close an orifice 60 in response to a fuel pressure change in the second circuit 30 to thereby modulate a size of the area through which a corresponding quantity of the second fuel flows from the second circuit 30 to the nozzle part 40. The circuit body 31 may include a valve seat 32 with the orifice 60 defined through the valve seat 32 as a passage having a substantially axial component 70 in some cases. With reference to FIGS. 5 and 6, the circuit body 31 may include an endcover 140 formed to define the orifice 60 as a passage having a radial component 142 and an axial component 143.

Referring to FIG. 1, the valve 50 may include an upstream head 81 and a downstream head 82, upon each of which the second fuel impinges, an axle 83, which extends between the upstream and downstream heads 81 and 82, and which is supported by the valve seat 32 to be axially movable in accordance with the second fuel pressure and a first elastic member 84. The first elastic member 84 may be a spring and may be at least one of linearly and non-linearly responsive to the second fuel pressure. The first elastic member 84 biases the downstream head 82 toward a downstream surface of the valve seat 32 to urge closure of the orifice 60.

With this construction, the valve 50 admits second fuel to the nozzle part 40 at a predefined second fuel pressure sufficient to energize the first elastic member 84 and continues to admit increasing quantities of the second fuel as the second fuel pressure increases and the downstream head 82 recedes from the valve seat 32.

Figure 2:
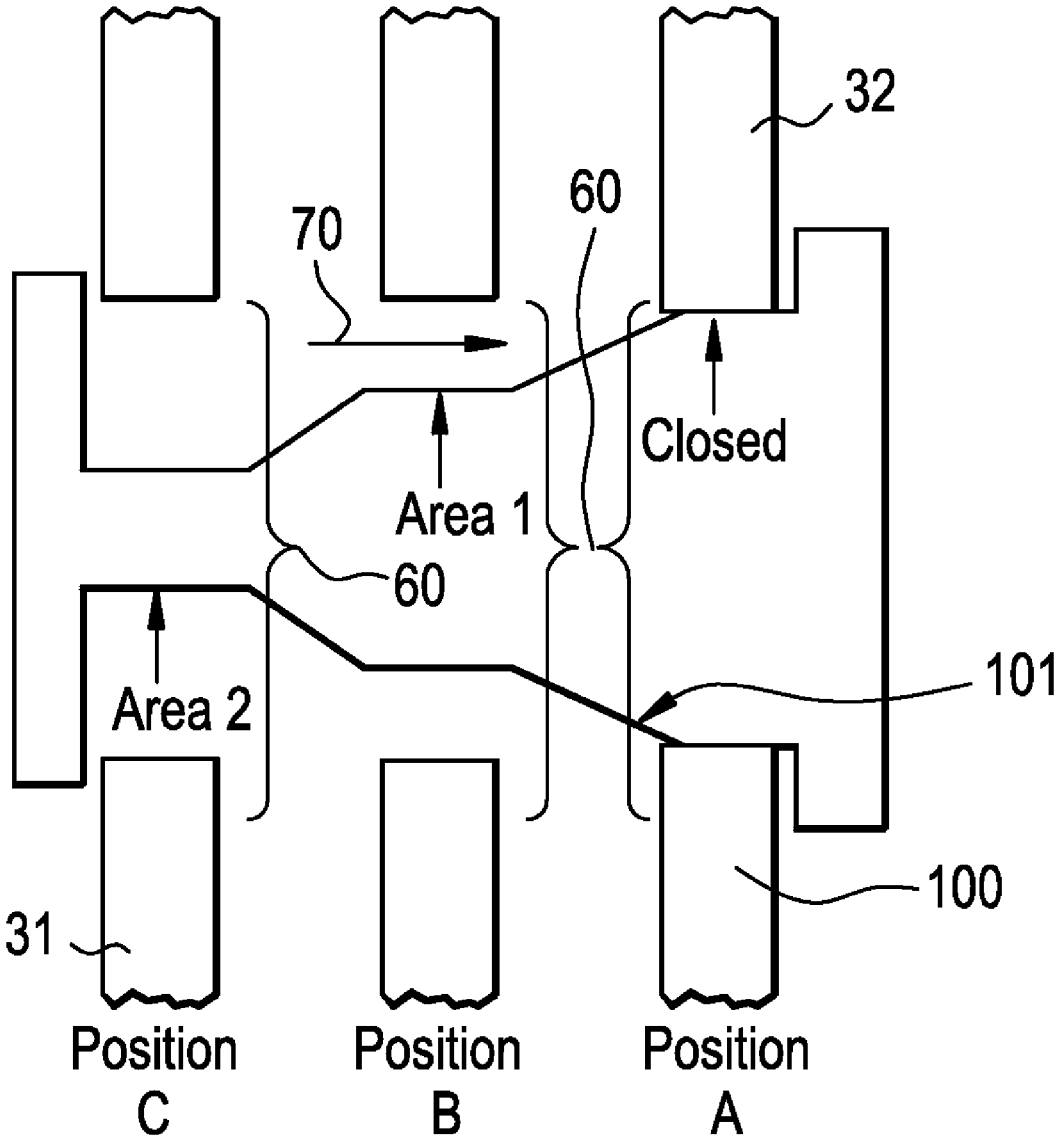
FIG. 2 is a side sectional view of a fuel nozzle according to embodiments.
Figure 3:
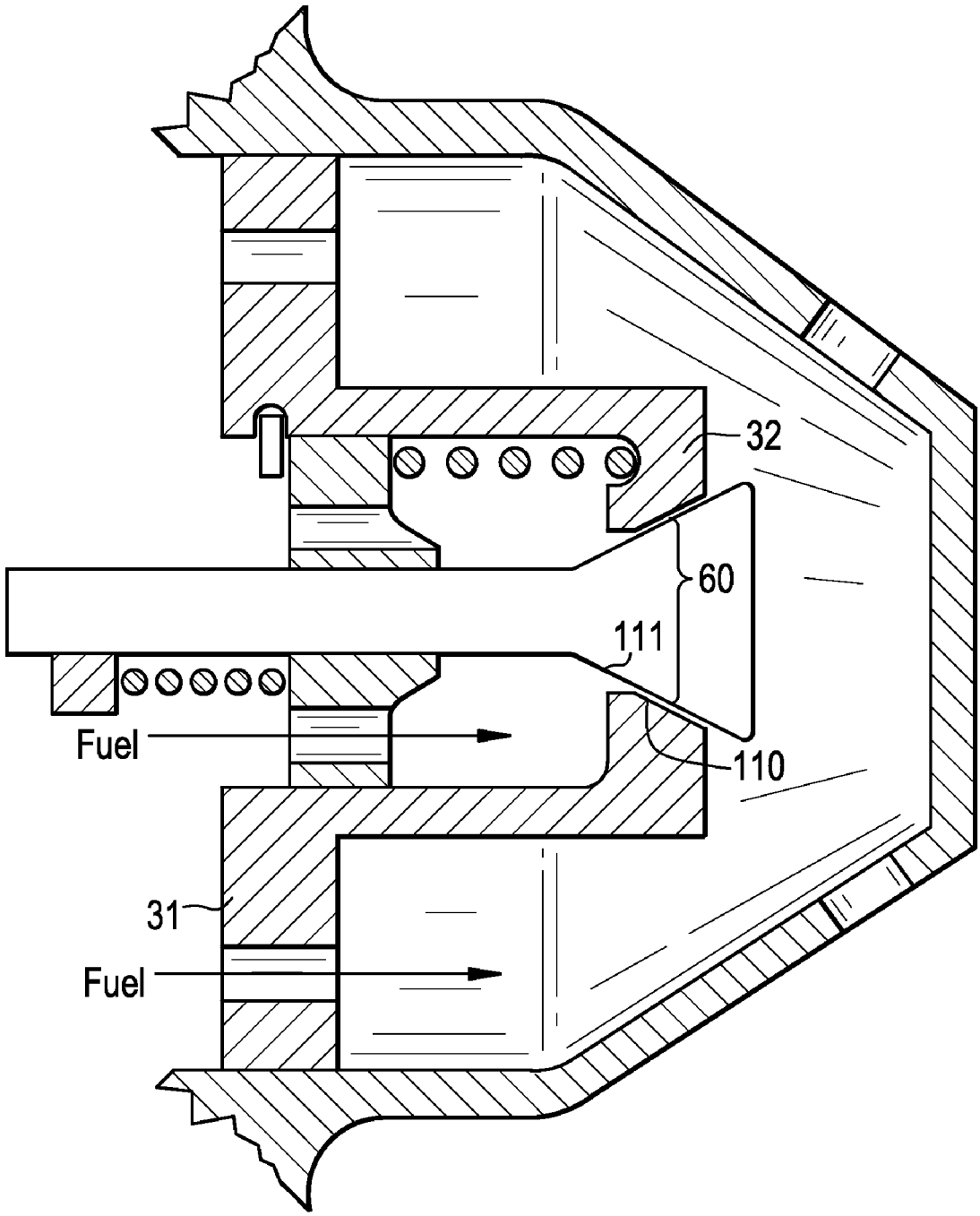
FIG. 3 is a side sectional view of a fuel nozzle according to further embodiments.

As shown in FIG. 2, the valve seat 32 and the valve 50 may each include complementary stepped profiles 100, 101 at the orifice 60. In this way, at position A, the profiles 100, 101 are formed such that the valve seat 32 and the valve 50 abut one another and do not admit second fuel to the nozzle part (i.e., the orifice 60 is closed). However, as the second fuel pressure increases and the valve 50 approaches positions B and C, the valve seat 32 and the valve 50 have space in between them and second fuel can be admitted to the nozzle part 40 (i.e., the orifice 60 is opened). Moreover, since the C position is characterized by a larger opening that the B position more fuel can pass through the C position opening. Thus, whether the valve 50 is linearly or non-linearly responsive to the second fuel pressure, the valve 50 may admit different quantities of the second fuel at increasing second fuel pressures. In an alternate embodiment, as shown in FIG. 3, the valve seat 32 and the valve 50 may each include complementary continuously variable surface profiles 110, 111 at the orifice 60.

Figure 4:
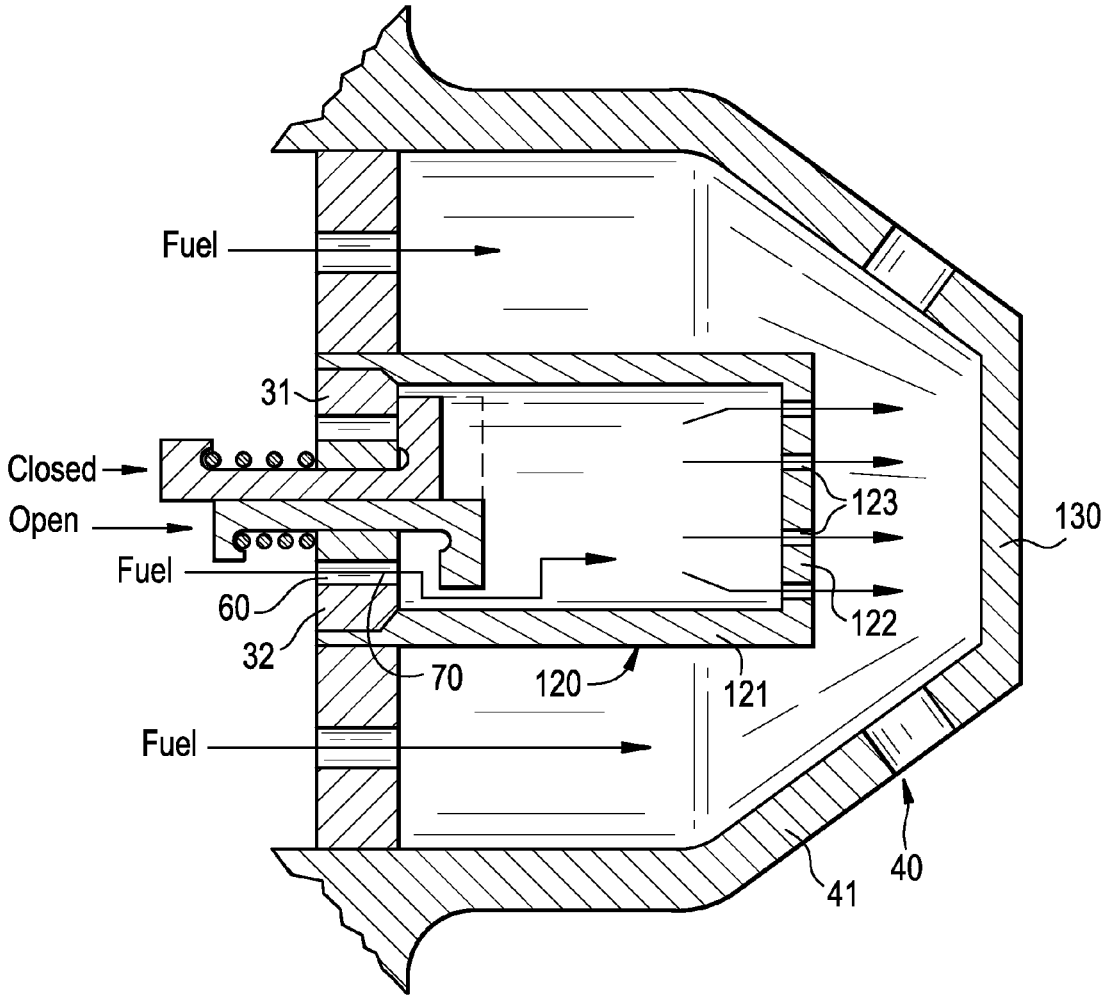
FIG. 4 is a side sectional view of a fuel nozzle according to further embodiments.

With reference to FIG. 4, a downstream circuit 120 may be formed to extend axially from the circuit body 31 to deliver the second fuel, having passed through the orifice 60, to a surface 130 of the nozzle part 40 for impingement cooling thereof The downstream circuit 120 is thus partially disposed within the conical section 41 of the nozzle part 40 and includes sidewalls 121 extending from the valve seat 32 and an end portion 122 proximate the surface 130, which is formed to define through-holes 123 that direct second fuel toward the surface 130.

As mentioned above and with reference to FIGS. 5 and 6, the circuit body 31 may include an endcover 140 formed to define a fuel channel groove 141 with the orifice 60 being defined as a passage between the fuel channel groove 141 and the nozzle part 40. The orifice 60 thus includes a radial component 142 extending radially inwardly from a sidewall of the fuel channel groove 141 and an axial component 143 in communication with the radial component 142 and extending axially toward the nozzle part 40.

The valve 50 may include a boss 150 disposed along the orifice 60, a valve body 160 having a surface 161, upon which the second fuel impinges, and a second elastic member 170, which may include a spring and which is passively responsive to the second fuel pressure. The second elastic member 170 serves to bias the valve body 160 toward the boss 150 to thereby urge closure of the orifice 60.

With this construction, the closure of the orifice 60 is achieved at predefined second fuel pressures insufficient to energize the second elastic member 170 such that complementary surface profiles 171, 172 of the valve body 160 and the boss 150 abut one another. The valve 50 admits second fuel to the nozzle part 40 at a predefined second fuel pressure sufficient to energize the second elastic member 170 and continues to admit increasing quantities of the second fuel as the second fuel pressure increases and the valve body 160 recedes from the boss 150.

Although the valve 50 is illustrated in FIGS. 5 and 6 as being disposed within the axial component 143 of the orifice 60, it is understood that this is merely exemplary and that the valve 50 may also be disposed within the radial component 142. It is further understood that the valve 50 may be provided in pairs with each valve 50 of the pair disposed in the radial and axial components 142, 143. In this case, each of the pair of valves 50 may be opened and closed at similar or varied second fuel pressures.

The boss 150 may be formed as a component of an insert 180 that is removably insertable into the radial or the axial component 142, 143. In this case, the insert 180 may include a screw-top 181 and both the insert and the sidewall of the orifice 60 may include complementary threading such that the insert 180 can be screwed into the orifice 60 for fastening. This is, of course, merely exemplary and it is understood that other fastening systems for the insert 180 may be provided.

The second elastic member 170 may be anchored to a second boss 190 downstream from the boss 150. Here, the second boss 190 may be formed as part of the sidewall of the orifice 60 or as a further separate component. In any case, the second boss 190 supports the second elastic member 170 and the valve body 160 against the second fuel pressure.

As shown in FIG. 5, endcover 140 may have one or more multi-nozzle assemblies 42. In this case, the valve 50 and the orifice 60 may each be plural in number and arrayed at plural locations relative to the second circuit 30. In particular, the valves 50 and the orifices 60 may be arrayed with substantially uniform spacing and/or complementary directionality around the circuit body 31. Moreover, the valves 50 may each be oriented at least one of radially and axially within the orifices 60.

The descriptions provided above can be applied to eliminate air purge requirements for DLN and/or multi-nozzle quiet combustors (MNQC), single nozzle arrays or any fuel nozzle that requires multiple fuels circuits in the combustor. Eliminating purge circuits and equipments can provide significant hardware and contractual cost savings that can multiply at fleet level. Also, passively controlled valves provide variable area geometry for changing a fuel wobbe index throughout the operating range of a system to thereby increase fuel flexibility of the system. Moreover, variable area geometries mitigate dynamics effects due to reduced fuel side pressure fluctuations.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A nozzle, comprising:

a first fuel circuit carrying a first fuel by which the first fuel is delivered to a nozzle part;

a second fuel circuit carrying a second fuel and disposed in parallel with the first fuel circuit by which the second fuel is delivered to the nozzle part, the second fuel being a relatively low BTU fuel as compared to the first fuel; and a valve, interposed between the second fuel circuit and the nozzle part and upon which the second fuel impinges, an opening and closing of the valve being passively responsive to a second fuel pressure in the second fuel circuit such that the valve thereby modulates a size of an area through which a corresponding quantity of the second fuel flows from the second circuit to the nozzle part.

2. The nozzle according to claim 1, wherein the second fuel circuit is selectively operated.

3. The nozzle according to claim 1, wherein the valve is spring-loaded.

4. The nozzle according to claim 3, wherein the spring-loaded valve at least one of linearly and non-linearly responds to a second fuel pressure change.

5. The nozzle according to claim 3, wherein the spring-loaded valve is configured to at least one of linearly and non-linearly modulate the size of the area.

6. A nozzle, comprising:

a first fuel circuit carrying a first fuel by which the first fuel is delivered to a nozzle part;

a selectively operated second fuel circuit carrying a second fuel, disposed in parallel with the first fuel circuit and including a body formed to define an orifice, by which the second fuel is delivered to the nozzle part, the second fuel being a relatively low BTU fuel as compared to the first fuel; and a valve, interposed between the second fuel circuit and the nozzle part and upon which the second fuel impinges, which passively opens and closes the orifice in response to a second fuel pressure in the second circuit, the opening and closing of the orifice by the valve thereby modulating a size of an area through which a corresponding quantity of the second fuel flows from the second fuel circuit to the nozzle part.

7. The nozzle according to claim 6, wherein the second circuit body comprises a valve seat formed to define the orifice as a passage having an axial component.

8. The nozzle according to claim 7, wherein the valve comprises:

a head, upon which the second fuel impinges; and a first elastic member, responsive the second fuel pressure, to bias the head toward the valve seat to urge closure of the orifice.

9. The nozzle according to claim 7, wherein the valve seat and the valve each comprise complementary stepped profiles at the orifice.

10. The nozzle according to claim 7, wherein the valve seat and the valve each comprise complementary continuously variable surface profiles at the orifice.

11. The nozzle according to claim 7, further comprising a downstream circuit to deliver the second fuel from the orifice to a surface of the nozzle part for impingement cooling thereof.

12. The nozzle according to claim 6, wherein the second circuit body comprises an endcover formed to define the orifice as a passage having radial and axial components.

13. The nozzle according to claim 12, wherein the valve comprises:

a boss disposed along the orifice;

a valve body, upon which the second fuel impinges; and an elastic member, responsive to the second fuel pressure, to bias the valve body toward the boss to urge closure of the orifice.

14. The nozzle according to claim 13, wherein the valve body and the boss each comprise complementary surface profiles.

15. The nozzle according to claim 13, wherein the boss, the valve body and the elastic member are disposed together within one or both of the radial and the axial components.

16. A nozzle, comprising:

a circuit carrying a first fuel by which the first fuel is delivered to a nozzle part, and a selectively operated circuit carrying a second fuel, including a body formed to define orifices, by which the second fuel is delivered to the nozzle part, the second fuel being a relatively low BTU fuel as compared to the first fuel; and plural valves with each of the plural valves being respectively associated with each of the orifices, each of the plural valves being respectively interposed between the selectively operated circuit and the nozzle part and upon each of which the second fuel impinges such that each of the plural valves passively opens and closes the correspondingly respective orifices in response to a second fuel pressure in the selectively operated circuit, the opening and closing of the correspondingly respective orifices by each of the plural valves thereby modulating a size of an area through which a corresponding quantity of the second fuel flows from the selectively operated circuit to the nozzle part.

17. The nozzle according to claim 16, wherein each of the plural valves and the correspondingly respective orifices are arrayed with at least one of substantially uniform spacing and complementary directionality around the circuit body.

18. The nozzle according to claim 16, wherein each of the plural valves and the correspondingly respective orifices are jointly or separately oriented at least one of radially and axially.

* * * * *